US008464742B2

(12) United States Patent
Bekkum

(10) Patent No.: US 8,464,742 B2
(45) Date of Patent: Jun. 18, 2013

(54) INJECTION OR OTHER SYSTEM WITH ANTI-THERMAL LOCKDOWN MECHANISM AND RELATED METHOD

(75) Inventor: Frank Van Bekkum, Norcross, GA (US)

(73) Assignee: Honeywell International Inc., Morristown, NJ (US)

( * ) Notice: Subject to any disclaimer, the term of this patent is extended or adjusted under 35 U.S.C. 154(b) by 649 days.

(21) Appl. No.: 12/704,008

(22) Filed: Feb. 11, 2010

(65) Prior Publication Data

US 2011/0192466 A1 Aug. 11, 2011

(51) Int. Cl.
*F15D 1/00* (2006.01)
*F01B 31/00* (2006.01)

(52) U.S. Cl.
USPC ..... 137/14; 137/861; 92/132

(58) Field of Classification Search
USPC ..... 137/14, 861; 92/132
See application file for complete search history.

(56) References Cited

U.S. PATENT DOCUMENTS 3,472,285 A 10/1969 Ginsburgh et al.
4,112,938 A 9/1978 Jeretin
4,317,469 A * 3/1982 Pauliukonis ..... 137/625.65
4,418,717 A 12/1983 Pauliukonis
5,038,563 A 8/1991 McMahan et al.
5,344,044 A 9/1994 Hayden et al.
5,542,450 A 8/1996 King et al.
5,590,936 A * 1/1997 Reuter ..... 303/116.1
5,673,722 A 10/1997 Brass
6,004,127 A * 12/1999 Heimberg et al. ..... 431/179
6,609,534 B1 8/2003 Beaney et al.
2008/0189846 A1 8/2008 Gardenier
2009/0235921 A1 * 9/2009 Heusser et al. ..... 126/604
2010/0018583 A1 1/2010 Hicks et al.

OTHER PUBLICATIONS

"Mono-Block II", Honeywell Enraf, Aug. 2009, 4 pages.
"Mini-Pak 3000", Honeywell Enraf, Aug. 2009, 4 pages.
"Additive Monitoring System, User Manual", Honeywell Enraf, Nov. 8, 2008, 24 pages.
Kathy West, "Ethanol Blending, Displacing the myths—it doesn't have to be expensive or complicated for terminal operations", ProcessWest, Mar. 2009, p. 39-40.

* cited by examiner

*Primary Examiner* — Kevin Lee

(57) ABSTRACT

An apparatus includes a first valve configured to selectively direct material to first and second outlets and a second valve configured to block the second outlet. The first and second valves define a dead space that has a volume between the first and second valves. The apparatus also includes a pressure compensation unit configured to dynamically provide an additional volume for material trapped in the dead space when the trapped material expands. The pressure compensation unit could include a piston configured to move within a space of the pressure compensation unit, where increased pressure in the dead space causes the trapped material to push against the piston in order to provide the additional volume for the trapped material. The pressure compensation unit could further include a spring configured to bias the piston and a seal configured to substantially prevent the trapped material from passing the piston and contacting the spring.

20 Claims, 3 Drawing Sheets

INJECTION OR OTHER SYSTEM WITH ANTI-THERMAL LOCKDOWN MECHANISM AND RELATED METHOD

TECHNICAL FIELD

This disclosure relates generally to pressure-relieving systems. More specifically, this disclosure relates to an injection system or other system with an anti-thermal lockdown mechanism and related method.

BACKGROUND

Injection systems are used in a wide variety of industries to inject a specified amount of one material in another material. For example, injection systems are routinely used to inject one or more additives into a stream of fuel. Often times, these injection systems need to be highly accurate so that the amount of injected material can be precisely controlled. To support this, an injection system often includes a diverter valve and a test port. The diverter valve can be used to divert the injected material to the test port, where the amount of injected material can be accurately measured. In this way, it is possible to determine whether the injection system is injecting the proper amount of material.

In many injection systems, the test port itself often includes a valve, which is usually closed when the test port is not in use. It is therefore possible for material to become trapped between the diverter valve and the test port valve. If the temperature of the injection system increases, this can cause the trapped material to expand. This expansion can actually rupture a seal in one or more of the valves, allowing material to leak from the injection system. As a particular example, this could occur if the material is trapped during the nighttime hours and the trapped material is later heated during the daytime hours.

Conventional injection systems typically deal with this problem using check valves that divert excess pressure. Unfortunately, this increases the complexity and cost of the injection systems. This also provides additional locations where leaks can form in the injection systems.

SUMMARY

This disclosure provides an injection or other system with an anti-thermal lockdown mechanism and related method.

In a first embodiment, an apparatus includes a first valve configured to selectively direct material to first and second outlets and a second valve configured to block the second outlet. The first and second valves define a dead space that has a volume between the first and second valves. The apparatus also includes a pressure compensation unit configured to dynamically provide an additional volume for material trapped in the dead space when the trapped material expands.

In a second embodiment, a method includes operating first and second valves, where material is trapped in a dead space defined by the first and second valves during operation of the valves. The method also includes, as the trapped material expands, dynamically providing an additional volume for the trapped material to enter in order to maintain a pressure in the dead space below a threshold.

In a third embodiment, an apparatus includes a dead space that has a volume in which material becomes trapped. The apparatus also includes a pressure compensation unit having a piston configured to move within a space of the pressure compensation unit. The pressure compensation unit is configured such that increased pressure in the dead space causes the trapped material to push against the piston in order to provide an additional volume for the trapped material.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
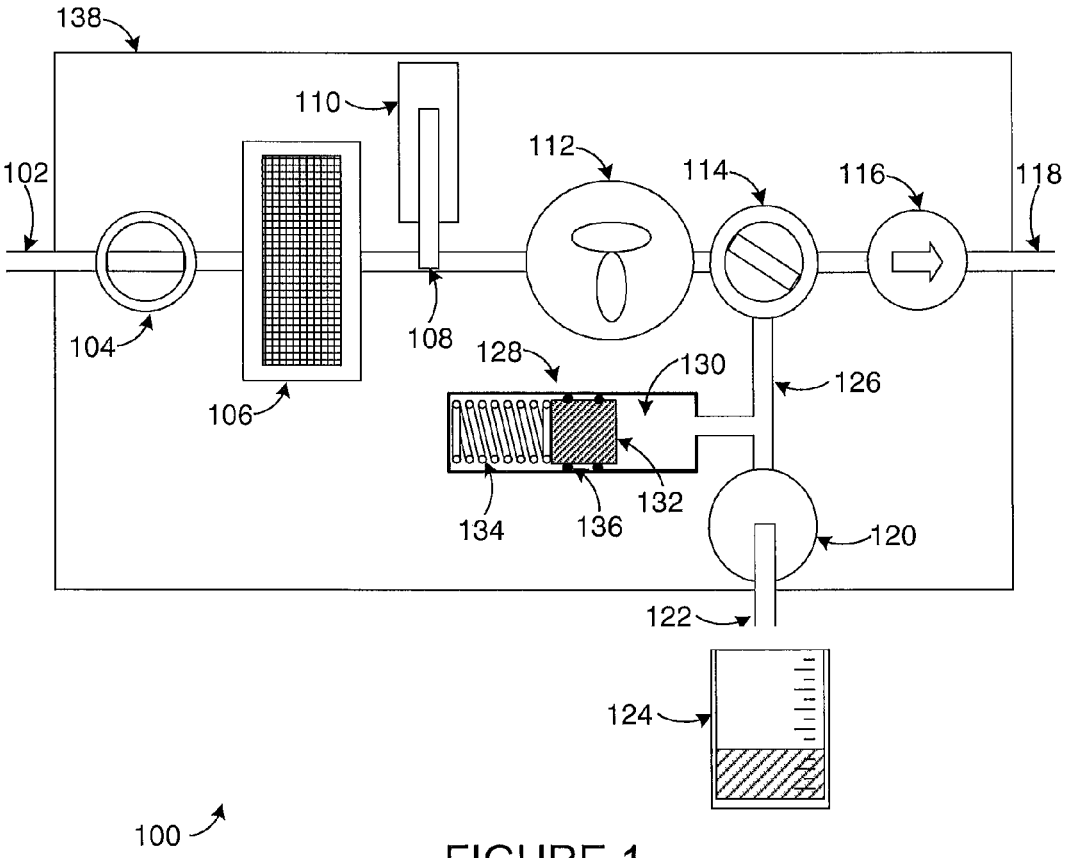
FIG. 1 illustrates an example injection system with an anti-thermal lockdown mechanism according to this disclosure.
Figure 2:
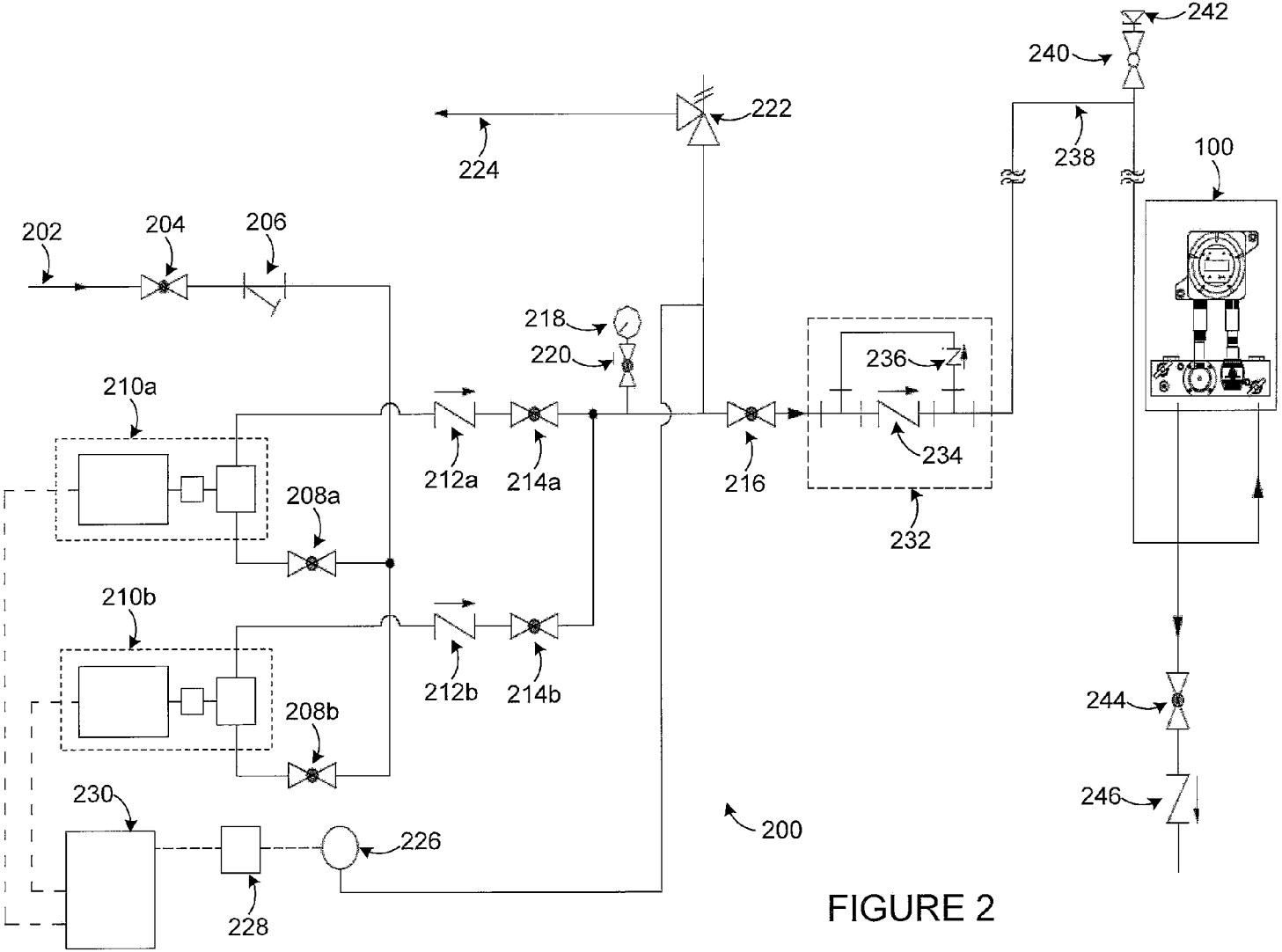
FIG. 2 illustrates an example fuel processing system that includes an injection system with an anti-thermal lockdown mechanism according to this disclosure.
Figure 3:
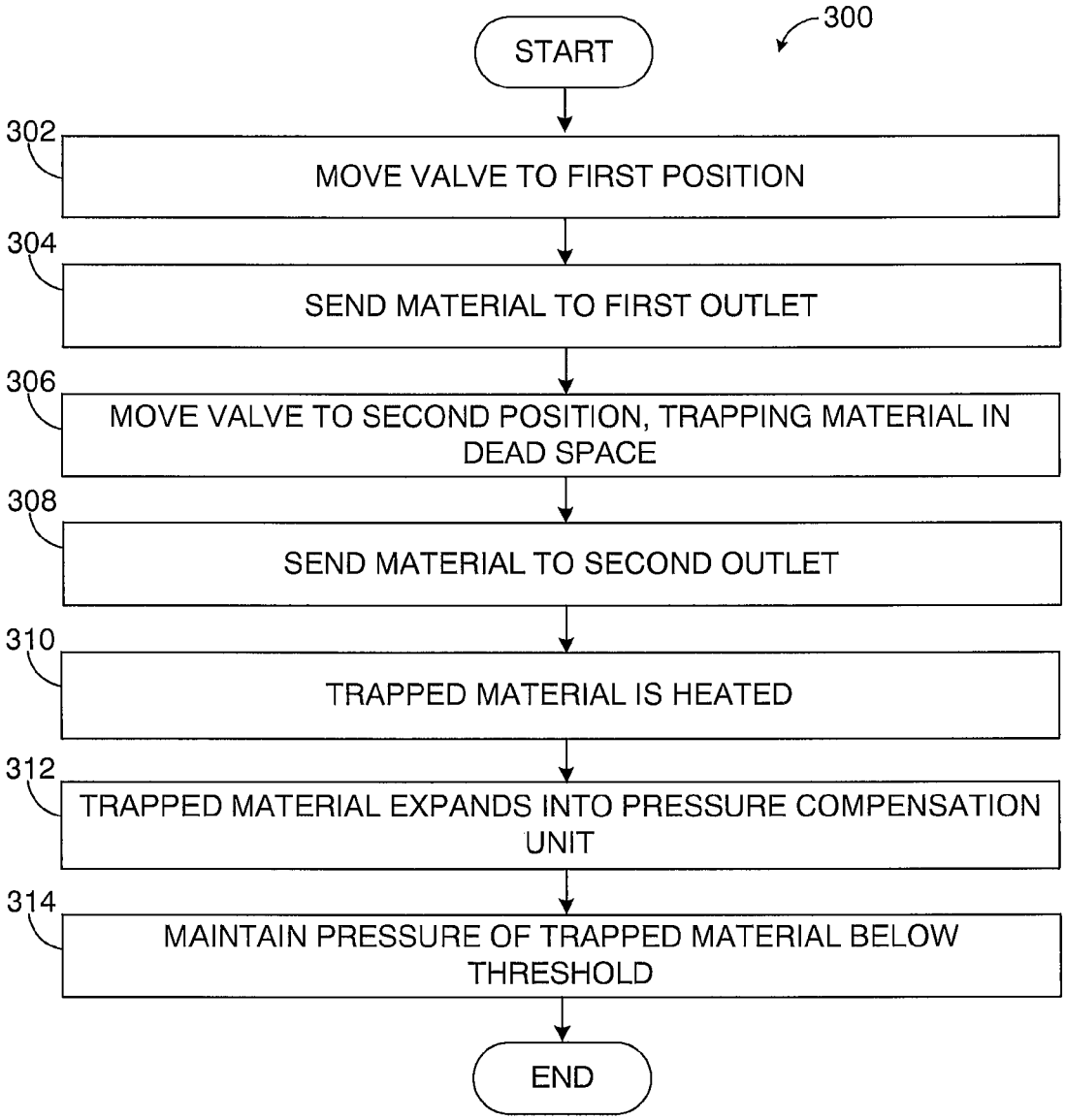
FIG. 3 illustrates an example method for anti-thermal lockdown in an injection system or other system according to this disclosure.

FIGS. 1 through 3, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

FIG. 1 illustrates an example injection system 100 with an anti-thermal lockdown mechanism according to this disclosure. The embodiment of the injection system 100 shown in FIG. 1 is for illustration only. Other embodiments of the injection system 100 could be used without departing from the scope of this disclosure.

As shown in FIG. 1, the injection system 100 receives material to be injected through an inlet 102. The inlet 102 includes any suitable structure through which one or more materials can flow to the injection system 100, such as a pipe or tube. Also, the material to be injected could include any suitable material(s), such as one or more fuel additives.

An inlet block valve 104 can be used to allow or block the flow of material into the injection system 100. For example, the inlet block valve 104 could be closed to prevent material from entering the injection system 100 during cleaning or replacement of other components in the system 100 or during times when the system 100 is not in use. The inlet block valve 104 includes any suitable structure for blocking or allowing the flow of material into the injection system 100. The inlet block valve 104 could, for example, represent a manually-operated valve.

A streamer 106 receives material flowing through the valve 104 and filters the material. For example, the streamer 106 can help to remove particles or other undesirable contaminants from the incoming material. Among other things, this can help to protect the other components of the injection system 100. The streamer 106 includes any suitable filtering structure, such as a strain basket.

A dosing valve 108 controls the amount of filtered material that is injected by the injection system 100, and a dosing controller 110 controls the operation of the dosing valve 108. For example, the dosing valve 108 can be opened more or opened more often (when a solenoid valve is used) by the dosing controller 110 when more material needs to be injected. The dosing valve 108 can be closed more or closed more often by the dosing controller 110 when less material needs to be injected. The dosing valve 108 can also be completely closed to stop the injection of the material. The dosing valve 108 includes any suitable structure for controlling a flow of material, such as a solenoid-operated valve. The dosing controller 110 includes any suitable structure for controlling a dosing valve, such as a load computer, a programmable logic controller (PLC), or other computing or control device.

A flow meter 112 measures the amount of material provided by the dosing valve 108. The flow meter 112 can then provide these measurements back to the dosing controller 110. In this way, the dosing controller 110 receives feedback from the flow meter 112 and can adjust operation of the dosing valve 108 so that, for instance, an appropriate amount of material is being provided by the dosing valve 108. The flow meter 112 includes any suitable structure for measuring a flow of material, such as an oval gear positive flow meter or other flow meter.

A diverter valve 114 controls where the material being injected actually exits the injection system 100. During a first mode of operation, the diverter valve 114 can be set so that the material provided by the dosing valve 108 is provided to a check valve 116 and a first outlet 118. During a second mode of operation (such as a testing mode), the diverter valve 114 can be set to redirect the material provided by the dosing valve 108 to a test port 120 and a second outlet 122. During a third mode of operation, the valve 104 can block the material, and the injection system 100 can be turned off.

The check valve 116 is located between the diverter valve 114 and the first outlet 118 of the injection system 100. During the first mode of operation, the diverter valve 114 provides material to the check valve 116, which passes the material to the first outlet 118. The check valve 116 prevents "back flow" of the material when the outlet pressure exceeds the inlet pressure. The diverter valve 114 includes any suitable structure for controlling the flow of material, such as a manually-operated valve. The check valve 116 includes any suitable structure for substantially limiting the flow of material in one direction.

In this example, the injection system 100 injects the material out through the first outlet 118. The outlet 118 includes any suitable structure through which one or more materials can flow out of the injection system 100, such as a pipe or tube. The material flowing through the outlet 118 can be injected into any other material(s). As a specific example, the injection system 100 can receive one or more fuel additives through the inlet 102 and inject the fuel additive(s) through the outlet 118 into a base product, such as gasoline, diesel fuel, or jet fuel.

During the second mode of operation, the diverter valve 114 provides material to the test port 120, which is located between the diverter valve 114 and the second outlet 122. The test port 120 can be connected to a test device, which collects the material flowing through the second outlet 122. The test port 120 includes any suitable structure for providing material to a testing device. The test port 120 typically includes a small valve that blocks the second outlet 122 when testing is not occurring. The second outlet 122 includes any suitable structure through which one or more materials can flow out of the injection system 100, such as a pipe or tube.

In this example, material flowing out of the second outlet 122 is provided to a beaker 124. The beaker 124 collects and accurately measures the amount of dispensed material. In this way, personnel can collect the dispensed material for a specified amount of time and then compare the collected amount of material to a target amount. This allows the personnel to test whether the injection system 100 is injecting an appropriate amount of material. Note that the use of a beaker 124 as part of the testing is for illustration only and that other techniques could be used to measure the amount of dispensed material or otherwise test the injection system 100.

During the first mode of operation, the diverter valve 114 typically blocks the path to the test port 120, and the valve in the test port 120 is typically closed. This can trap material within a dead space 126 of the injection system 100. The dead space 126 generally denotes a volume in which material can become trapped when each exit from the space is sealed. As noted above, in conventional injection systems, material can expand when its temperature increases. This could conceivably burst a seal in the diverter valve 114 or in the test port 120, causing leakage of the material.

In accordance with this disclosure, the injection system 100 includes a pressure compensation unit 128, which can be used to relieve pressure in the dead space 126 of the injection system 100. In this example, the compensation unit 128 includes a space 130 into which material from the dead space 126 can enter. The compensation unit 128 also includes a piston 132 that can move within the space 130. The piston 132 is biased using a spring 134, and the piston 132 is sealed against one or more edges of the space 130 using one or more seals 136.

In one aspect of operation, the spring 134 biases the piston 132 in a forward direction (closer to the dead space 126). Material trapped in the dead space 126 can contact the piston 132, but the seals 136 generally prevent the material from moving past the piston 132 and filling the portion of the space 130 on the left of the piston 132 in FIG. 1. This effectively creates an air pocket in the left portion of the space 130 in FIG. 1.

When the material in the dead space 126 is not expanding or contracting, the piston 132 may remain in a generally stable position. When the material in the dead space 126 heats up, the material can expand, causing the material to push against the piston 132. This moves the piston 132 in a reverse direction (towards the spring 134), increasing the space that the trapped material can occupy and preventing a large pressure increase within the dead space 126. When the material in the dead space 126 cools, the material can contract, and the spring 134 can push the piston 132 in the forward direction. Effectively, the pressure compensation unit 128 can be used to dynamically adjust a volume occupied by the trapped material, which adjusts the pressure in the dead space 126.

In this way, the pressure compensation unit 128 can help to maintain the pressure within the dead space 126 below a threshold point where any seals might burst. This can help to reduce or prevent leakages in the injection system 100 caused by expansion of trapped material in the dead space 126. Moreover, this compensation can be done without introducing additional leakage points and without interfering with the accuracy of test measurements taken when the test port 120 is used. In addition, this approach avoids the need to use a check valve to divert any excess pressure away from the dead space 126, which eliminates an additional point where leakages could occur.

The pressure compensation unit 128 includes any suitable structure allowing material in a confined space to expand. In this example embodiment, the space 130 includes any suitable volume in which material can enter and other components of the compensation unit 128 can operate. The space 130 could, for example, represent a cylindrical volume. Note that the space 130 could join with the dead space 126 in any suitable manner. While FIG. 1 shows a small channel connecting these spaces, larger openings could be used. The piston 132 includes any suitable structure that moves within a space. The piston 132 could, for example, represent a cylindrical structure having a diameter less than or approximately equal to a diameter of the cylindrical space 130.

The spring 134 includes any suitable structure for biasing the piston 132. The spring 134 can be selected so that, at the lowest pressure during normal operating conditions, the spring 134 is not activated. Note that the spring 134 is only one example of a biasing mechanism that could be used in the pressure compensation unit 128. In other embodiments, compressed or uncompressed gas or air could be used as the counter-force. The gas or air could be injected into the space 130, and the piston 132 and seal 136 could trap the gas or air in the space 130. This gas or air could then push against the piston 132 and bias the piston 132 in the forward direction.

Each seal 136 includes any suitable structure for substantially sealing a portion of the space 130. Any number of seals 136 could be used. Each seal 136 could, for example, represent an O-ring. Note that the piston 132 and the seal(s) 136 could also be formed as a single integrated unit. For instance, the piston 132 and the seal(s) 136 could be formed from a single piece of polytetrafluoroethylene (PTFE).

In some embodiments, many of the components shown in FIG. 1 can be formed or used in an integrated or unibody structure. For example, a structure 138 could be machined or cast out of one piece of solid metal or other material(s). This unibody structure 138 could include many of the channels and spaces shown in FIG. 1, along with areas where other components can be inserted into the structure 138. After formation of this structure 138, many of the components in the system 100 could be machined and inserted into the structure 138. This can help to reduce or minimize the number of seals required in the system 100, which can significantly reduce the number of possible leakage points in the system 100.

Although FIG. 1 illustrates one example of an injection system 100 with an anti-thermal lockdown mechanism, various changes may be made to FIG. 1. For example, the injection system 100 could have any other or additional components in any suitable arrangement. The pressure compensation unit 128 can generally be used in any injection system or other system in which pressure within a dead space needs to be controlled or relieved.

FIG. 2 illustrates an example fuel processing system 200 that includes an injection system 100 with an anti-thermal lockdown mechanism according to this disclosure. The embodiment of the fuel processing system 200 shown in FIG. 2 is for illustration only. Other embodiments of the fuel processing system 200 could be used without departing from the scope of this disclosure.

As shown in FIG. 2, the fuel processing system 200 includes an inlet 202, which receives fuel from storage (such as a storage tank). An isolation valve 204 controls the flow of fuel into the system 200, and a strainer 206 filters the fuel entering the system 200. Two isolation valves 208*a*-208*b* control the flow of filtered fuel to two motor/pump units 210*a*-210*b*, respectively. The motor/pump units 210*a*-210*b* pump the filtered fuel through check valves 212*a*-212*b* and isolation valves 214*a*-214*b*, respectively. Each check valve 212*a*-212*b* helps to ensure the filtered fuel flows substantially in one direction, and each isolation valve 214*a*-214*b* controls the flow of filtered fuel to a pump outlet isolation valve 216. The pump outlet isolation valve 216 generally controls or stops the flow of filtered fuel being pumped.

Various components are used to monitor, control, and relieve pressure of the pumped fuel. For example, a pressure gauge 218 connected to an isolation valve 220 can display a pressure of the pumped fuel. Also, a bypass relief valve 222 can provide the pumped fuel through an outlet 224. This can be done, for example, to provide some of the pumped fuel back to storage when the pressure of the pumped fuel is too high. In addition, a pressure sensor 226 can measure the pressure of the pumped fuel and send the pressure measurements to a pressure controller 228. The pressure controller 228 can use the pressure measurements to control a motor controller 230, which can control operation of the motor/pump units 210*a*-210*b*. For example, the pressure controller 228 can signal the motor controller 230 when the measured pressure exceeds a maximum pressure threshold or falls below a minimum pressure threshold. The motor controller 230 could then adjust operation of the motor/pump units 210*a*-210*b*, such as by increasing or decreasing the pump rate or shutting down the motor/pump units 210*a*-210*b*.

The pumped fuel flowing through the pump outlet isolation valve 216 is provided to a pump discharge bypass relief kit 232, which includes a discharge check valve 234 and a thermal relief valve 236. The fuel that passes through the discharge bypass relief kit 232 enters an overhead additive line 238. The overhead additive line 238 is connected to a high point bleed with an isolation valve 240 and a plug 242. The overhead additive line 238 feeds the fuel to an injection system 100, which injects one or more materials (such as one or more additives) into the fuel. As noted above, the injection system 100 includes a pressure compensation unit 128 that can help to regulate the pressure within a dead space 126 of the injection system 100. This can help to avoid leaks in the injection system 100.

The fuel with the injected material is provided to an isolation valve 244, which controls the flow to a check valve 246. The check valve 246 provides the fuel with the injected material to any suitable destination, such as a tanker truck or other storage vehicle or storage structure.

Each of the components shown in FIG. 2 includes any suitable structure for performing the described function(s).

Although FIG. 2 illustrates one example of a fuel processing system 200 that includes an injection system 100 with an anti-thermal lockdown mechanism, various changes may be made to FIG. 2. For example, FIG. 2 illustrates one example arrangement of a fuel processing system. Fuel could be processed in any other suitable manner. Material can be injected into fuel using any number of injection systems 100 at any number of locations within a larger fuel processing system. Also, the pressure compensation unit 128 shown in FIG. 1 and described above could be used in any suitable larger system, whether or not that system relates to fuel processing or injection. As particular examples, the injection system 100 could be used in marine applications to inject additives into fuel for marine vessels, aviation applications to inject de-icing or other additives into jet fuel, or biofuel applications to inject additives into biofuel or to inject biofuel into diesel or other fuel.

FIG. 3 illustrates an example method 300 for anti-thermal lockdown in an injection system or other system according to this disclosure. The embodiment of the method 300 shown in FIG. 3 is for illustration only. Other embodiments of the method 300 could be used without departing from the scope of this disclosure. Also, for ease of explanation, the method 300 is described with respect to the injection system 100 of FIG. 1. However, the method 300 could be used with any other suitable system.

As shown in FIG. 3, a valve is moved to a first position at step 302, and material is sent to a first outlet at step 304. The valve is moved to a second position at step 306, and material is sent to a second outlet at step 308. Material is trapped in a dead space when the valve is moved to the second position. As a particular example of this, these steps may include moving the diverter valve 114 in the injection system 100 to a test position and then moving the diverter valve 114 to a normal operating position. This can trap material in the dead space 126 of the injection system 100.

The trapped material is heated at step 310, which may occur for any number of reasons (such as an increase in ambient temperature). This causes the trapped material to expand into a pressure compensation unit at step 312. This could include, for example, the trapped material pushing the piston 132 into the space 130, allowing the trapped material to partially fill the space 130. As a result, the pressure of the trapped material is maintained below a threshold at step 314. More specifically, the trapped material can expand into the space 130 as needed to maintain the pressure within the dead space 126 below a pressure that might otherwise burst a seal in the injection system 100.

Although FIG. 3 illustrates an example method 300 for anti-thermal lockdown in an injection system or other system, various changes may be made to FIG. 3. For example, while FIG. 3 shows as a series of steps, various steps in the method 300 could overlap, occur in parallel, occur in a different order, or occur multiple times. Also, the same or similar method could be used in any system in which pressure within a dead space needs to be relieved.

It may be advantageous to set forth definitions of certain words and phrases used throughout this patent document. The terms "include" and "comprise," as well as derivatives thereof, mean inclusion without limitation. The term "or" is inclusive, meaning and/or.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a first valve configured to selectively direct material to first and second outlets;

a second valve configured to block the second outlet, wherein the first and second valves when closed define a dead space comprising a volume between the first and second valves; and a pressure compensation unit configured to dynamically provide an additional volume for material trapped in the dead space when the trapped material expands.

2. The apparatus of claim 1, wherein:

the pressure compensation unit comprises a piston configured to move within a space of the pressure compensation unit; and the pressure compensation unit is configured such that increased pressure in the dead space causes the trapped material to push against the piston in order to provide the additional volume for the trapped material.

3. The apparatus of claim 2, wherein the pressure compensation unit further comprises:

a spring configured to bias the piston.

4. The apparatus of claim 3, wherein the pressure compensation unit further comprises:

a seal configured to substantially prevent the trapped material from passing the piston and contacting the spring.

5. The apparatus of claim 1, wherein the pressure compensation unit is configured to receive some of the trapped material into the additional volume in order to maintain a pressure in the dead space below a threshold.

6. The apparatus of claim 1, wherein a space within the pressure compensation unit and the dead space comprise connected spaces within a unibody structure.

7. The apparatus of claim 1, wherein:

the first valve comprises a diverter valve;

the first outlet is configured to inject the material into a product stream;

the second valve comprises part of a test port; and the second outlet is configured to inject the material into a test device.

8. The apparatus of claim 1, further comprising:

an inlet configured to receive the material;

a third valve configured to block the inlet;

a streamer configured to filter the material flowing through the third valve;

a dosing valve configured to control an amount of filtered material provided to the first valve;

a flow meter configured to measure the amount of filtered material provided to the first valve; and a dosing controller configured to adjust the dosing valve based on feedback from the flow meter.

9. A method comprising:

operating first and second valves, wherein material is trapped in a dead space defined by the first and second valves when the first and second valves are closed; and as the trapped material expands, dynamically providing an additional volume for the trapped material to enter in order to maintain a pressure in the dead space below a threshold.

10. The method of claim 9, wherein dynamically providing the additional volume comprises:

moving a piston within a space of a pressure compensation unit.

11. The method of claim 10, wherein increased pressure in the dead space causes the trapped material to push the piston towards a spring in order to provide the additional volume for the trapped material.

12. The method of claim 11, further comprising:

as the trapped material contracts, pushing the trapped material out of the additional volume and back into the dead space using the piston.

13. The method of claim 10, wherein the space within the pressure compensation unit and the dead space comprise connected spaces within a unibody structure.

14. The method of claim 9, wherein operating the first and second valves comprises:

in a first mode of operation, operating the first valve to divert the material to a first outlet and opening the second valve to unblock the first outlet; and in a second mode of operation, operating the first valve to divert the material to a second outlet and closing the second valve to form the dead space.

15. The method of claim 9, wherein the threshold comprises a pressure threshold above which a seal in the first or second valve bursts.

16. An apparatus comprising:

first and second valves configured to create a dead space comprising a volume in which material becomes trapped when the first and second valves are closed; and a pressure compensation unit comprising a piston configured to move within a space of the pressure compensation unit, wherein the pressure compensation unit is configured such that increased pressure in the dead space causes the trapped material to push against the piston in order to provide an additional volume for the trapped material.

17. The apparatus of claim 16, wherein the pressure compensation unit further comprises:

a spring configured to bias the piston.

18. The apparatus of claim 17, wherein the pressure compensation unit further comprises:

a seal configured to substantially prevent the trapped material from passing the piston and contacting the spring.

19. The apparatus of claim 16, wherein the pressure compensation unit is configured to receive some of the trapped material into the additional volume in order to maintain a pressure in the dead space below a threshold.

20. The apparatus of claim 16, further comprising:

an inlet configured to receive the material;

a third valve configured to block the inlet;

a streamer configured to filter the material flowing through the third valve;

a dosing valve configured to control an amount of filtered material provided to the first valve;

a flow meter configured to measure the amount of filtered material provided to the first valve; and a dosing controller configured to adjust the dosing valve based on feedback from the flow meter.

* * * * *